US005328283A

United States Patent [19]

Viens

[11] Patent Number: 5,328,283

[45] Date of Patent: Jul. 12, 1994

[54] MULTI-FUNCTION GLASS CLEANING APPARATUS

[76] Inventor: Jacques Viens, 1486 Bellemare, Roxton Pond, Québec, Canada, J0E 1Z0

[21] Appl. No.: 158,532

[22] Filed: Nov. 29, 1993

[51] Int. Cl.[5] ..... A47L 1/08

[52] U.S. Cl. ..... 401/23; 401/8; 401/37; 401/205; 401/207; 401/140

[58] Field of Search ..... 401/8, 23, 37, 205, 401/207, 140

[56] References Cited

U.S. PATENT DOCUMENTS

| | | | |
|---|---|---|---|
| 947,145 | 1/1910 | Ax | 401/207 |
| 1,727,277 | 9/1929 | Dies | 401/205 |
| 1,977,483 | 10/1934 | Koukal | 15/126 |
| 2,028,079 | 1/1936 | Steigerwald | 401/205 |
| 2,082,582 | 6/1937 | Kling | 15/126 |
| 2,886,839 | 5/1959 | Leopoldi | 15/126 |
| 4,778,301 | 10/1988 | Sicotte | 401/139 |
| 4,954,001 | 9/1990 | Billat | 401/139 |
| 5,054,945 | 10/1991 | Iggulden | 401/23 |

FOREIGN PATENT DOCUMENTS

| | | |
|---|---|---|
| 93339 | 1/1901 | Canada . |
| 258979 | 3/1926 | Canada . |
| 373714 | 3/1938 | Canada . |

*Primary Examiner*—Steven A. Bratlie

*Attorney, Agent, or Firm*—Edwin E. Greigg; Ronald E. Greigg

[57] ABSTRACT

A multi-function glass cleaning apparatus having a container provided With an opening closable by a plug, two principal opposite faces and two side walls, for receiving and storing a cleaning fluid. A handle is formed integrally with the container and defines a hand grasping portion. The hand grasping portion is transverse to the side walls. A first support member is formed integrally with the container on one of the faces thereof for supporting a scraping element which is secured to it. The first support member is parallel to the hand grasping portion and has a trough extending lengthwise thereof. The trough is in communication with the container via a small aperture. A second support member is formed integrally with the container for supporting a wiper which is secured to it. The second support member is parallel to the hand grasping portion and to the first support member. The apparatus has a mechanism for opening and closing the aperture so as to control the rate of feed of the cleaning fluid from the container through the aperture to the scraping element. When the apparatus is being used, the cleaning fluid contained in the container can exit the container through the aperture at a selected rate of feed and flow through the trough to wet the scraping element evenly.

20 Claims, 4 Drawing Sheets

MULTI-FUNCTION GLASS CLEANING APPARATUS

BACKGROUND OF THE INVENTION a) Field of the Invention

The present invention relates to a multi-function glass cleaning apparatus.

b) Brief Description of the Prior Art

Known in the art, there is U.S. Pat. No. 2,082,582 of W.H. KLING granted on May 9, 1936. This patent is representative of many patents describing window cleaning devices having a handle perpendicular to a fluid tank which supports a wiper and a scraping element, such as a sponge. In this patent, the tank has a discharge opening in the form of a slot so that the cleaning fluid escaping through the slot will be taken up by a wick. Furthermore, by regulating the tightness of bolts, the rate of feed of the cleaning fluid from the tank to the wick can be adjusted rapidly.

Also known in the art, there is U.S. Pat. No. 2,886,839 of N. LEOPOLDI, granted on May 19, 1959. This patent describes a window cleaning device including a compressible container adapted for serving as a handle for cleaning elements mounted thereon. These elements are a sponge, a rubber blade and a rigid scraper. The container has a small aperture effective for producing a liquid spray when the container is filled with liquid.

Also known in the art, there is U.S. Pat. No. 5,054,945 of J. IGGULDEN et al., granted on Oct. 8, including a bottle used as a handle and having a sponge and a rubber blade attached thereto. The liquid cleaning solution contained in the bottle is discharged through bores therein, and the amount of discharged fluid is controlled by valve means. The valve means allow the liquid cleaning solution to exit the bottle through the bores only under pressure created by squeezing the bottle.

Also known in the art, there are the following patents which describe different glass cleaning devices:

Canadian patents nos.: 70,136 of E.M. FARMER, granted in 1901 258,979 of P. THOMPSON, granted on Mar. 16, 1926 373,714 of W. WESSELER, granted in 1938;

U.S. Pat. Nos.: 1,977,483 of L. KOUKAL, granted on Oct. 16, 1934 4,778,301 of P. SICOTTE, granted on Oct. 18, 1988 4,954,001 of A.E. BILLAT, granted on Sep. 4, 1990

One drawback with the glass cleaning devices shown in the above patents is that the rate of feed of the cleaning fluid from the container to the scraping element, such as the sponge, cannot be adjusted with an adequate precision and thereby a waste of cleaning fluid occurs.

OBJECTS AND SUMMARY OF THE INVENTION

It is therefore an object of the present invention to provide a multi-function glass cleaning apparatus with a feed system that adjusts with an adequate precision the rate of feed from the container to the scraping element, such as a sponge, and wets the sponge evenly.

It is another object of the present invention to provide a multi-function glass cleaning apparatus which is compact and easy to handle.

In accordance with the present invention, the above objects are achieved with a multi-function glass cleaning apparatus with a scraping element feed system, which comprises a container having an opening closable by a plug, two principal opposite faces and two side walls, for receiving and storing a cleaning fluid. A handle is formed integrally with a container and defines a hand grasping portion, the hand grasping portion being transverse to these side walls.

A first support member is also formed integrally with the container on one of the faces thereof for supporting a scraping element. The first support member is parallel to the hand grasping portion and has a trough extending lengthwise thereof, the trough being in communication with the container via a small aperture. A second support member is further formed integrally with the container for supporting a wiper. The second support member is parallel to the hand grasping portion and the first support member.

Means are provided for opening and closing the aperture so as to control the rate of feed of the cleaning fluid from the container through the aperture to the scraping element. First securing means are also provided for securing the scraping element to the first support member. Second securing means are further provided for securing the wiper to the second support member.

When the above apparatus is being used, the cleaning fluid contained in the container can exit the container through the aperture at a selected rate of feed and flow through the trough to wet the scraping element evenly.

Preferably, the opening is located in one of the side walls and consists of a cylindrical bore with a threaded section. The plug used for closing the opening comprises a threaded portion sized so as to fit into and sealably engage the threaded section. The plug also comprises an aperture-closing portion positioned for opening and closing the aperture. The aperture-closing portion acts as means for opening and closing the aperture.

In operation, partial unscrewing of the plug controls the rate of feed of the cleaning fluid.

As can be appreciated, the apparatus is light and easy to handle. Preferably, the hand grasping portion is defined by an elongated through hole. Preferably also, the scraping element and the wiper are secured on a same face of the container, whereby both can be used separately or simultaneously depending on position of the user's wrist.

BRIEF DESCRIPTION OF THE DRAWINGS

In order to impart full understanding of the manner in which these and other objectives are attained in accordance with the present invention, a preferred embodiment thereof will be described hereinafter with reference to the accompanying drawings, wherein.

DESCRIPTION OF A PREFERRED EMBODIMENT

Figure 1:
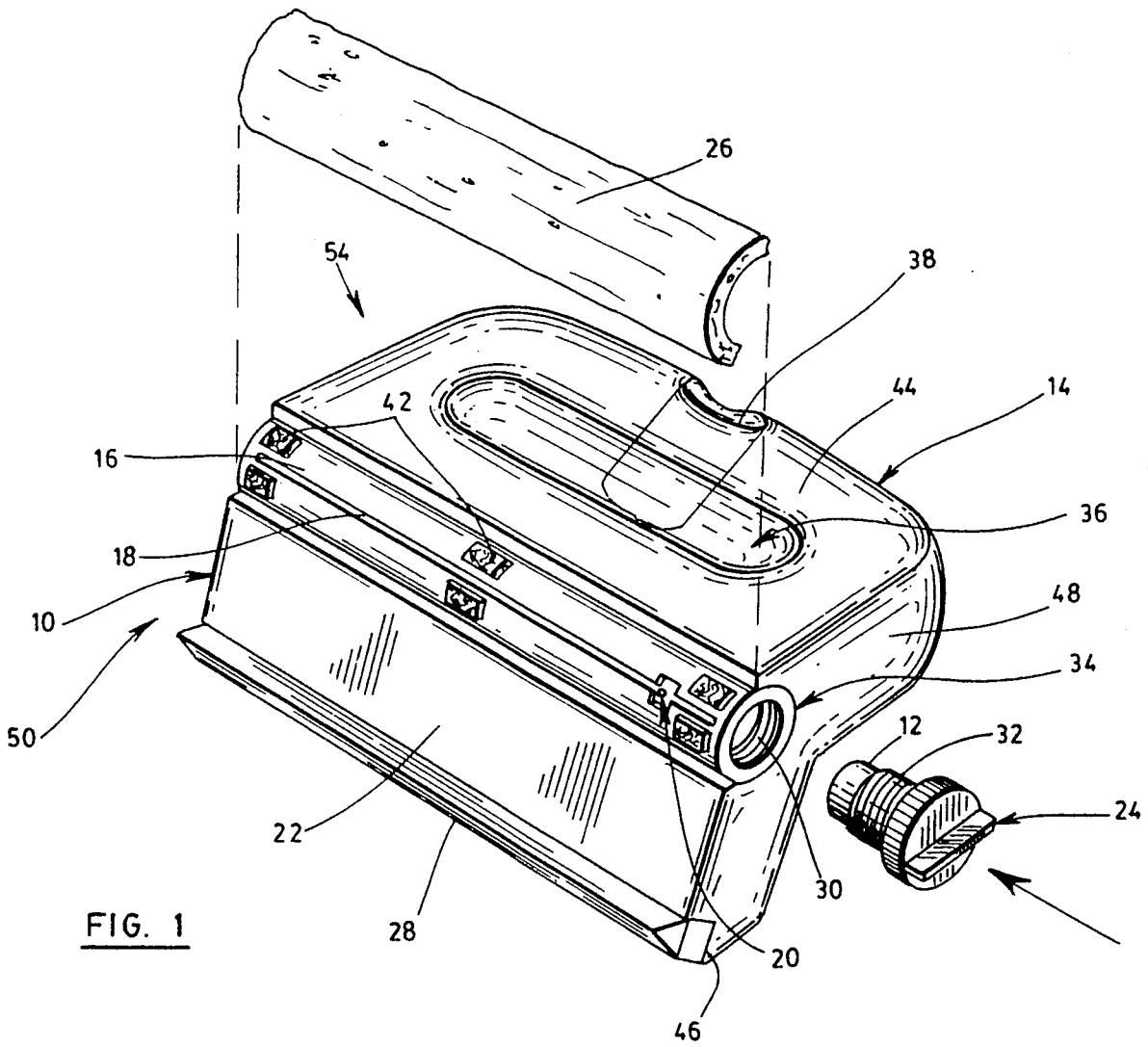
FIG. 1 is an exploded perspective view of a multi-function glass cleaning apparatus according to the present invention.

In FIG. 1, there is shown a multi-function glass cleaning apparatus according to the present invention comprising a container 10 moulded from a plastic material, and having an opening 34 closable by a plug 24, two principal opposite faces (only one numbered 54 is shown in the figure) and two sidewalls (only one numbered 48 is shown in the figure). The container 10 receives and stores a cleaning fluid.

A handle 14 is formed integrally with the container 10 defining a hand grasping portion 44 that is transverse to the sidewalls of the container 10. As is shown, the handle 14 and its hand grasping portion 44 are defined by an elongated through hole 36 made in the container 10. The hole 36 is parallel to a scraping element, such as a sponge with a fibrous cleaning surface 26 and to a wiper, such as a rubber blade 28.

It is worth mentioning, that the handle could be defined by a recess made in the container 10 instead of the elongated hole 36.

Figure 4:
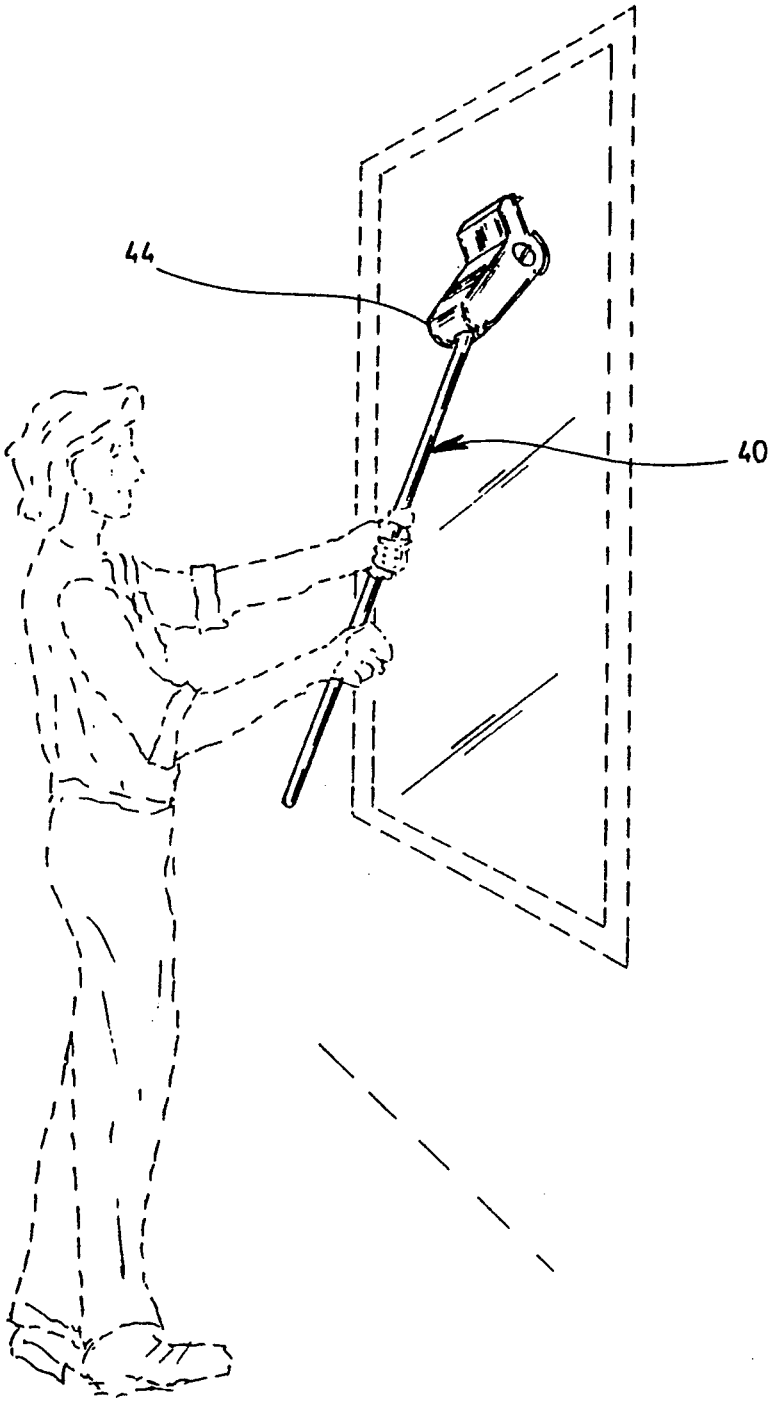
FIG. 4 is a view showing another manner of holding the multi-function glass cleaning apparatus with a rod attached thereto.

The hand grasping portion has a second hole 38 therein, the second hole 38 is normal to the first and second support members ,respectively 16 and 22, and is sized to receive one end of a rod 40. As shown in FIG. 4, the rod 40 is useful as an extension of the hand grasping portion 44.

Preferably, the second hole 38 and an end of the rod 40 are both threaded so as to positively engage together.

A first support member 16 is formed integrally with the container 10 on the face 54 thereof, and is used for supporting the sponge 26. The first support member 16 has a trough 18 extending lengthwise thereof, and is parallel to the hand grasping portion 44. The trough 18 is in communication with the container via a small aperture 20.

A second support member 22 is formed integrally with the container 10, and is for supporting the rubber blade 28. The second support member 22 is parallel to the hand grasping portion 44 and to the first Support member 16.

The first support member 16 and the second support member 22 are integral parts of a base 50, and the first support member 16 is at one end thereof. The hand grasping portion 44 extends from the one end of the base 50 at an angle of approximately 120° with respect to the base 50.

Figure 3:
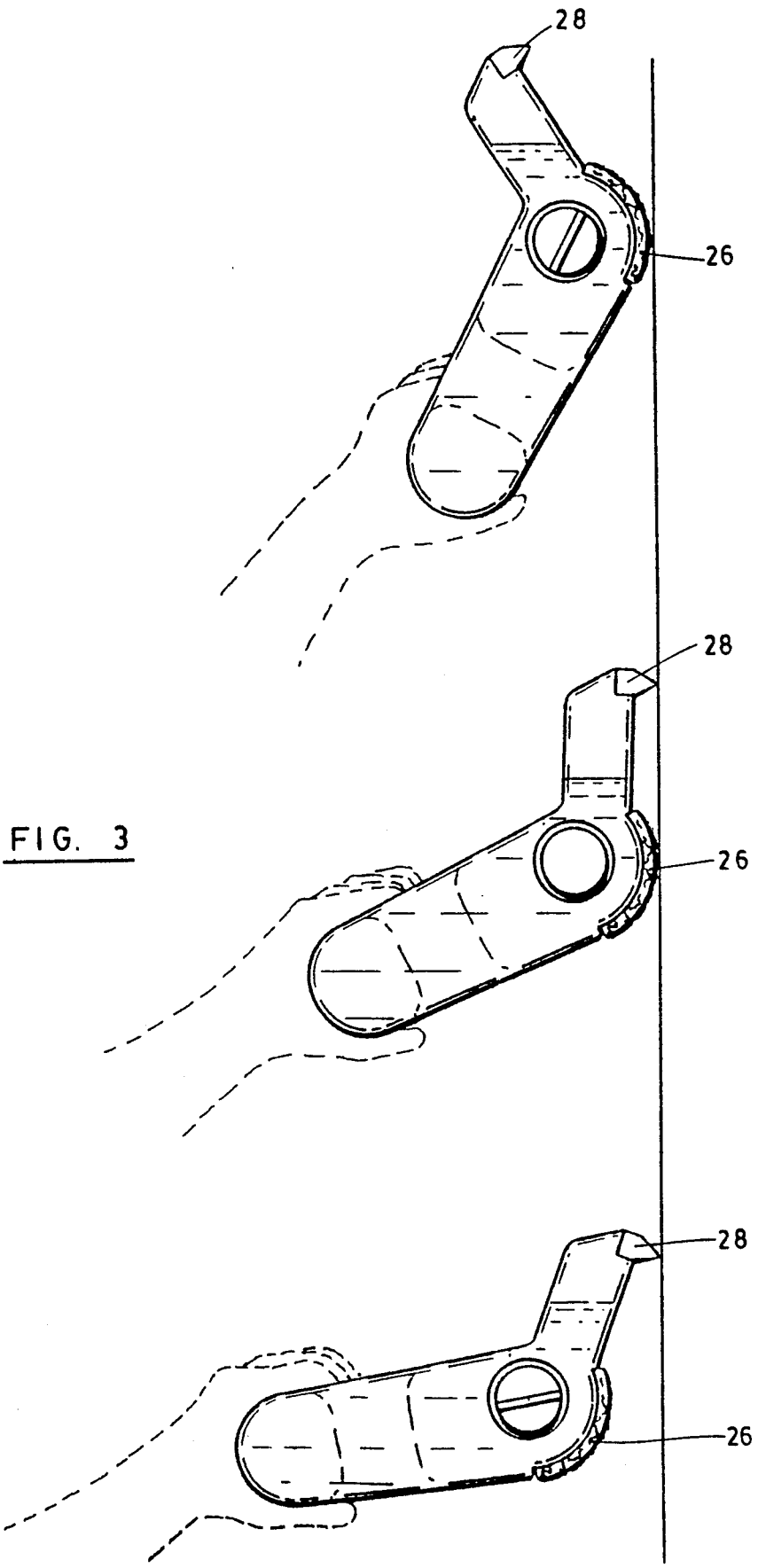
FIG. 3 is a view showing three different manners of using the multi-function glass cleaning apparatus of the present invention.

Thanks to this 120° angulation of the container 10 and the fact that the sponge 26 and the rubber blade 28 are both secured on the same face 54 of this container, the multi-function apparatus can be used in three different manners depending on the position of the user's wrist. Thus, as shown on the left hand side of FIG. 3, the rubber blade 28 can be used separately. As shown on the right hand side of FIG. 3, the sponge can be used separately. Finally, as shown in the middle, both can be used simultaneously.

The apparatus includes elements for securing the sponge 26 to the first support member 16, and for securing the rubber blade 28 to the second support member 22. The elements for securing the sponge 26 can be of any type such as snaps or pins, but preferably these elements include pads 42 made from fibrous hooks-and-loops type material of the VELCRO type. The pads 42 are spaced apart along the first support member 16 on each side of the trough 18. When secured, the sponge is curved about the angle of approximately 120 degrees. The elements for securing the rubber blade 28 include a slot 46 at one end of the second support member 22. In operation, the rubber blade 28 is inserted into the slot 46.

The apparatus also includes a mechanism for opening and closing the aperture 20 so as to control the rate of feed of the cleaning fluid from the container 10 through the aperture 20 to the sponge 26.

Figure 2:
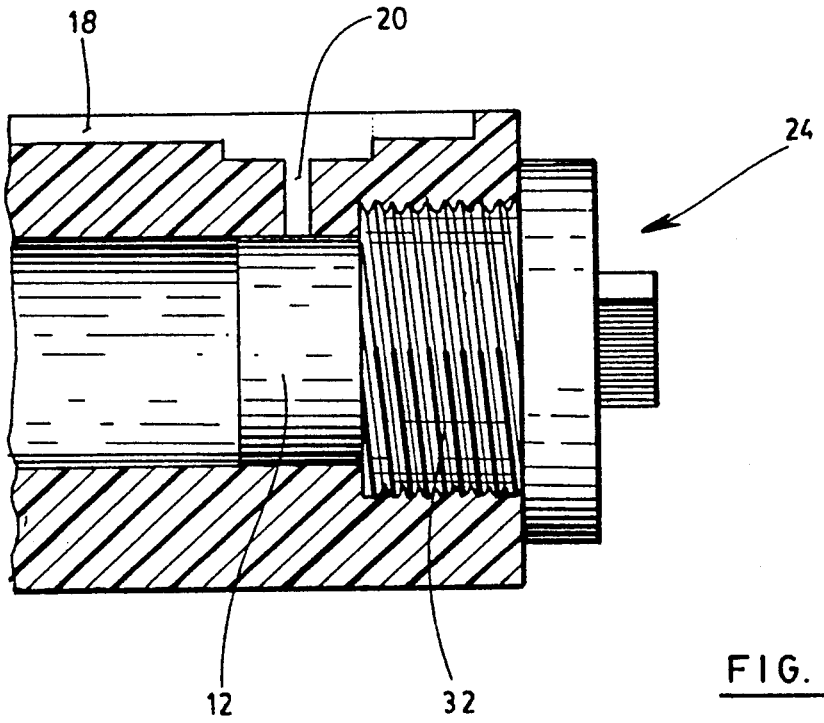
FIG. 2 is a fragmentary section view showing a plug used as the mechanism for adjusting the rate of feed.

Preferably, the opening 34 is located in the sidewall 48 of the container and consists of a cylindrical bore with a threaded section 30. The plug 24 is used for closing the opening 34 and comprises a threaded portion 32 sized so as to fit into and sealingly engage the threaded section 30. Also, as shown in FIG. 2, the plug 24 comprises an aperture closing portion 12 positioned for opening and closing the aperture 20, thereby the plug 24 acts as the mechanism for opening and closing the aperture 20.

In operation, when the apparatus is being used, the cleaning fluid contained in the container can exit the container through the aperture 20 at a selected rate of feed and flow through the trough 18 to wet the sponge 26 evenly. The user is able to select the rate of feed of the cleaning fluid by partially unscrewing the plug 24.

As can be appreciated, there .are various advantages to the multi-function apparatus as mentioned hereinbefore. Besides being light and very compact, the apparatus is also easy to handle and extremely effective with its new feed system. Furthermore, by replacing the sponge or the rubber blade when worn out, the apparatus can be used for an extended life-time.

Although the present invention has been explained hereinabove by way of a preferred embodiment thereof, it should be pointed out that any modifications to this preferred embodiment within the scope of the appended claims is not deemed to alter or change the nature and scope of the present invention.

The embodiments of the invention in which an exclusive property or privilege is claimed, are defined as follows:

1. A multi-function glass cleaning apparatus, comprising:

a container having an opening closable by a plug, two principal opposite faces and two side walls, for receiving and storing a cleaning fluid;

a handle formed integrally with said container and defining a hand grasping portion, said hand grasping portion being transverse to said side walls;

a first support member formed integrally with said container on one of the faces thereof, for supporting a scraping element, said first support member being parallel to said hand grasping portion and having a trough extending lengthwise thereof, said trough being in communication with said container via a small aperture;

a second support member formed integrally with said container, for supporting a wiper, said second support member being parallel to said hand grasping portion and said first support member;

means for opening and closing said aperture so as to control the rate of feed of said cleaning fluid from said container through said aperture to said scraping element;

first securing means for securing said scraping element to said first support member;

second securing means for securing said wiper to said second support member;

whereby, when said apparatus is being used, said cleaning fluid contained in said container can exit said container through said aperture at a selected rate of feed and flow through said trough to wet said scraping element evenly.

2. An apparatus according to claim 1, wherein:

said opening is located in one of said side walls and consists of a cylindrical bore with a threaded section;

said plug used for closing the opening comprises a threaded portion sized so as to fit into and sealingly engage said threaded section;

said plug also comprises an aperture-closing portion positioned for opening and closing said aperture, said aperture-closing portion acting as said means for opening and closing said aperture;

whereby, in operation, partial unscrewing of said plug controls the rate of feed of said cleaning fluid.

3. An apparatus according to claim 1, wherein said scraping element and said wiper are secured on the one face of said container.

4. An apparatus according to claim 2, wherein said scraping element and said wiper are secured on the one face of said container.

5. An apparatus according to claim 1, wherein said hand grasping portion is defined by a through hole made in said container.

6. An apparatus according to claim 2, wherein said hand grasping portion is defined by a through hole made in said container.

7. An apparatus according to claim 5, wherein said hole is elongated and generally parallel to said scraping element and said wiper.

8. An apparatus according to claim 6, wherein said hole is elongated and generally parallel to said scraping element and said wiper.

9. An apparatus according to claim 1, wherein said first support member and said second support member are integral part of a base, said first support member being at one end of said base, and said hand grasping portion extending from said one end at an angle of approximately 120° with respect to said base.

10. An apparatus according to claim 2, wherein said first support member and said second support member are integral part of a base, said first support member being at one end of said base, and said hand grasping portion extending from said one end at an angle of approximately 120° with respect to said base.

11. An apparatus according to claim 9, wherein said scraping element is curved about the angle of approximately 120°.

12. An apparatus according to claim 1, wherein said container is moulded from a plastic material.

13. An apparatus according to claim 2, wherein said container is moulded from a plastic material.

14. An apparatus according to claim 1, wherein said hand grasping portion has a second hole therein, said hole being normal to said first and second support members, said second hole being sized to receive one end of a rod useful as an extension of said hand grasping portion.

15. An apparatus according to claim 2, wherein said hand grasping portion has a second hole therein, said hole being normal to said first and second support members, said second hole being sized to receive one end of a rod useful as an extension of said hand grasping portion.

16. An apparatus according to claim 1, wherein said wiper is a rubber blade projecting outwardly from said second support member.

17. An apparatus according to claim 1, wherein said scraping element is a sponge with a fibrous cleaning surface.

18. An apparatus according to claim 17, wherein said first securing means include pads made from fibrous hooks-and-loops type material and spaced apart along said first support member on each side of said trough.

19. An apparatus according to claim 16, wherein said second securing means include a slot at an end of said second support member, for receiving said rubber blade.

20. An apparatus according to claim 4, wherein:

said scraping element is a sponge with a fibrous cleaning surface;

said wiper is a rubber blade projecting outwardly from said second support member;

said hand grasping portion is defined by a through hole made in said container;

said through hole is elongated and generally parallel to said Scraping element and said wiper;

said hand grasping portion has a second hole therein,-said second hole being normal to said first and second support members, said second hole being sized to receive one end of a rod useful as an extension of said hand grasping portion;

said first support member and said second support member are integral part of a base, said first support member being at one end of said base, and said hand grasping portion extending from said one end at an angle of approximately 120° with respect to said base;

said scraping element is curved about the angle of approximately 120°;

said container is moulded from a plastic material;

said first securing means include pads made from fibrous hooks-and-loops type material and spaced apart along said first support member on each side of said trough; and said second securing means include a slot at an end of said second support member, for receiving said rubber blade.

* * * * *